US010549824B2

(12) United States Patent
Bejrowski et al.

(10) Patent No.: US 10,549,824 B2
(45) Date of Patent: Feb. 4, 2020

(54) FLOATING VESSEL MODULAR PROTECTION AND SECURITY DEVICE

(71) Applicants: Daniel Joseph Bejrowski, Katy, TX (US); Edward Joseoh Bejrowski, Katy, TX (US)

(72) Inventors: Daniel Joseph Bejrowski, Katy, TX (US); Edward Joseoh Bejrowski, Katy, TX (US)

( * ) Notice: Subject to any disclaimer, the term of this patent is extended or adjusted under 35 U.S.C. 154(b) by 0 days.

(21) Appl. No.: 16/182,880

(22) Filed: Nov. 7, 2018

(65) Prior Publication Data

US 2019/0118913 A1 Apr. 25, 2019

Related U.S. Application Data

(63) Continuation-in-part of application No. 16/169,744, filed on Oct. 24, 2018.

(Continued)

(51) Int. Cl.

*B63C 5/00* (2006.01)
*E04B 7/16* (2006.01)

(Continued)

(52) U.S. Cl.

CPC ..... *B63C 5/00* (2013.01); *E04B 7/166* (2013.01); *E04H 6/025* (2013.01); *E04H 6/04* (2013.01); *E04H 15/36* (2013.01); *E04H 15/52* (2013.01)

(58) Field of Classification Search

CPC ..... E04B 1/3431; E04B 7/166; B63C 5/00; B63C 15/00; B63C 17/02; E04H 6/025; E04H 15/02; E04H 15/38; E04H 15/46

See application file for complete search history.

(56) References Cited

U.S. PATENT DOCUMENTS 1,456,478 A * 5/1923 White ..... E04B 1/34305 135/141
3,030,973 A * 4/1962 Janda ..... B63C 15/00 105/15

(Continued)

FOREIGN PATENT DOCUMENTS

FR 2526469 A1 * 11/1983 ..... E04B 1/34305
FR 2823783 A1 * 10/2002 ..... E04B 1/34305

OTHER PUBLICATIONS

Webpage (https://photos.app.goo.gl/fqg6221g55iPhwUn8), retrieved in 2017 on a date prior to this application, 12 photos.

*Primary Examiner* — Christine T Cajilig
(74) *Attorney, Agent, or Firm* — Nolte Intellectual Property Law Group

(57) ABSTRACT

A floating vessel modular protection and security device includes a stationary bowed frame configured to be positioned over a floating vessel, the stationary frame and a moveable bowed frame. A stationary flexible cover extends from one end to the other end of the stationary bowed frame, covering stationary crossbeams. The stationary flexible cover having a length from end to end that is shorter than a length of the floating vessel. A moveable flexible cover extends from one end to the other end of the moveable bowed frame, covering the movable bowed frame crossbeams. The movable bowed frames slides on the upper moveable frame track and lower stationary frame track simultaneously to repeatedly retract and deploy to access or secure a floating vessel.

12 Claims, 5 Drawing Sheets

Related U.S. Application Data

(60) Provisional application No. 62/576,141, filed on Oct. 24, 2017.

(51) Int. Cl.

| | |
|---|---|
| ***E04H 6/02*** | (2006.01) |
| ***E04H 15/36*** | (2006.01) |
| ***E04H 15/52*** | (2006.01) |
| ***E04H 6/04*** | (2006.01) |

(56) References Cited

U.S. PATENT DOCUMENTS

| | | | | |
|---|---|---|---|---|
| 5,233,799 | A * | 8/1993 | Abukawa | B21D 5/08 52/53 |
| 6,851,227 | B1 * | 2/2005 | Schildge, Jr. | E04B 7/166 52/6 |
| 8,676,402 | B1 * | 3/2014 | Foster | B63C 15/00 114/44 |
| 8,701,356 | B2 * | 4/2014 | Forsland | E04B 1/34305 52/66 |
| 2009/0301537 | A1 * | 12/2009 | Finck | E04H 6/025 135/123 |

* cited by examiner

FLOATING VESSEL MODULAR PROTECTION AND SECURITY DEVICE

CROSS REFERENCE TO RELATED APPLICATIONS

The present application is a continuation in part of co-pending U.S. Non-Provisional Application Ser. No. 16/169,744 filed on Oct. 24, 2018, and claims priority to and the benefit of U.S. Provisional Patent Application Ser. No. 62/576,141 filed on Oct. 24, 2017, entitled "MODULAR PROTECTION AND SECURITY DEVICE. These references are hereby incorporated in their entirety.

FIELD

The present embodiments generally relate to a floating vessel modular protection and security device.

BACKGROUND

A need exists for an adjustable telescoping protection device that provides remote security monitoring for floating vessels.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present floating vessel in detail, it is to be understood that the apparatus is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

The invention relates to a floating vessel modular protection and security device for protecting a floating vessel such as a boat within a slip.

The invention relates to a floating vessel modular protection and security device for protecting a floating vessel.

The floating vessel modular protection and security device for protecting a floating vessel includes a stationary bowed frame and a plurality of stationary frame tracks mounted to a side of the stationary bowed frame.

A plurality of upper track rollers is mounted to the stationary bowed frame.

A moveable bowed frame is mounted to the upper track rollers and slidable over the stationary bowed frame.

The floating vessel modular protection and security device for protecting a floating vessel has plurality of moveable frame tracks are used.

Each moveable frame track is mounted to a side of the moveable bowed frame.

A plurality of lower track rollers are mounted to the movable bowed frame positioned for rolling within in the stationary frame track.

A first flexible cover is mounted to the stationary bowed frame and a second flexible cover is mounted to the moveable bowed frame.

The first flexible cover is configured to fit between the moveable bowed frame and the stationary bowed frame.

The floating vessel modular protection and security device prevents harm to the boat because a camera with a motion detector is used on the bowed frame.

The floating vessel modular protection and security device prevents injury by providing an automatic shut off for the motor if a person's appendage is trapped between the bowed frames.

The floating vessel modular protection and security device provides a safer assembly process. In embodiments, the components can use interference fit to engage, wherein no power tools are used, which prevents sever injuries.

The floating vessel modular protection and security device protects the environment by providing a modular construction which uses less materials that custom built boat and slip covers.

Due to the tubular construction of the device, the floating vessel modular protection and security device can be towed at 65 mph without ripping or tearing when mounted on a trailer.

Figure 1:
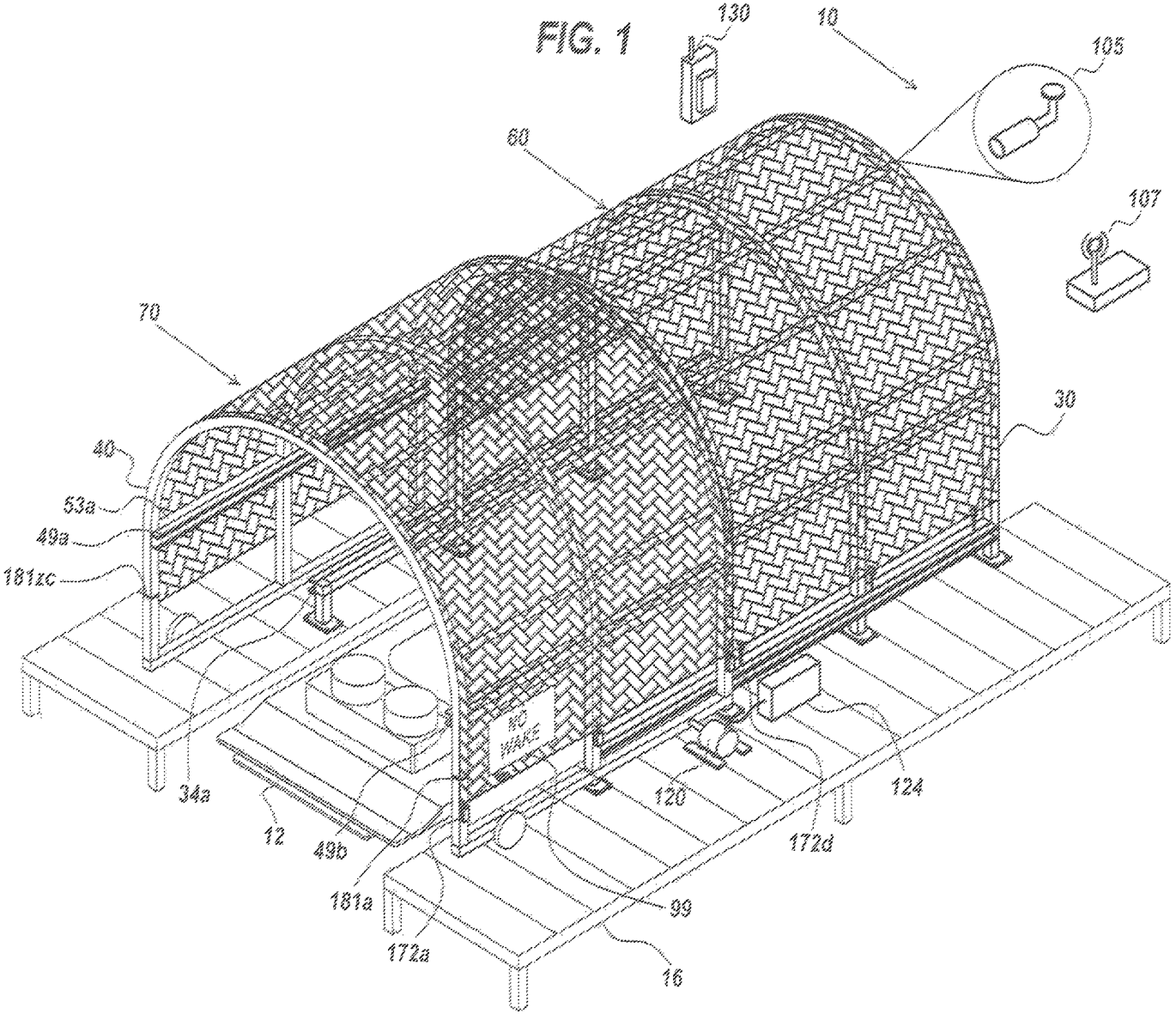
FIG. 1 is a perspective view of a floating vessel modular protection and security device according to one or more embodiments.

Turning now to the Figures, FIG. 1 is a perspective view of a floating vessel modular protection and security device 10 in an expanded position according to one or more embodiments.

The floating vessel modular protection and security device 10 has a stationary bowed frame 30, which is shown positioned over a floating vessel 12, such as a boat.

The stationary frame 30 has a plurality of stationary arched roof members, a plurality of lower stationary crossbeams connected between the stationary arched roof members, a plurality of upper stationary cross beams connected between the stationary arched roof members and spaced apart from the lower stationary cross beam.

A stationary flexible cover 60 is mounted over the stationary arched roof members and lower stationary crossbeams. The stationary flexible cover 60 extends from one end to the other end of the stationary bowed frame 30 covering the stationary crossbeams. The stationary flexible cover has a length from end to end that is shorter than a length of the floating vessel.

A first lower stationary frame track **34*a*** is secured to a first lower stationary cross beam. Not shown in this Figure is a second lower stationary frame track secured to the second lower stationary crossbeam.

Not shown in this Figure but in subsequent Figures are upper track rollers with each roller mounted to an opposite each side of an upper stationary cross beams.

A moveable bowed frame 40 is configured to repeatedly retract and deploy over the stationary bowed frame 30.

The moveable bowed frame 40 has a plurality of moveable arched roof members, a plurality of lower moveable crossbeams connected between the plurality of moveable arched roof members, and a pair of upper movable cross beams. Cross beam 53*a* is shown connected between the moveable arched roof members and a pair of upper moveable frame tracks 49*a* and 49*b*, wherein each upper moveable frame track is fastened to an upper moveable crossbeam.

A plurality of lower movable track rollers not shown in this Figure are each mounted to roll in the lower stationary frame tracks.

A moveable flexible cover 70 extends from one end to the other end of the moveable bowed frame 40, covering the movable bowed frame crossbeams.

The movable bowed frame 40 slides on the upper moveable frame track and lower stationary frame track simultaneously, to repeatedly retract and deploy to access or secure a floating vessel, the floating vessel modular protection and security device mounted on a dock 16. The stationary bowed frame 30 provides a clearance from 10% to 30% above the vessel height overall.

The floating vessel modular protection and security device 100 can include a message area 99 on the moveable flexible cover 70. The message can read "no wake" or a similar safety message and be pre-printed and pre-installed on the device.

The floating vessel modular protection and security device can include a wireless camera 105 connected to a power supply 124 to record weather and provide additional security images. The wireless camera 105 can be connected to a network 107 mounted to one end of the stationary bowed frame 30.

In embodiments, the floating vessel modular protection and security device 10 can have a motor with worm gear 120 mounted to the stationary bowed frame 30 for extending and retracting the moveable bowed frame along the stationary frame track, the motor can be connected to a power supply 124.

In embodiments, the floating vessel modular protection and security device can have a remote control 130 connected to a network 107 for actuating the motor 120 from a remote location.

The floating vessel modular protection and security device is shown having a plurality of moveable bowed frame tensioners.

In embodiments, the moveable bowed frame tensioners are quick release frame tensioners which enable the flexible cover to be quickly removed in the event a known storm with heavy winds.

Each of moveable bowed frame tensioners can be mounted to one of the moveable arched roof members. Each of the moveable bowed frame tensioners can be configured for providing a load to the second flexible cover.

In embodiments, the floating vessel modular protection and security device can include a plurality of stationary elastic fasteners 181*a*-181*zc*, wherein the plurality of elastic fasteners secure the moveable flexible cover 70 to the plurality moveable arched roof members.

In embodiments, the floating vessel modular protection and security device can include a plurality of elastic fasteners 180, wherein the plurality of elastic fasteners secure the stationary flexible cover 60 to the plurality stationary arched roof members and the moveable flexible cover to the plurality of moveable arched roof members.

Figure 2:
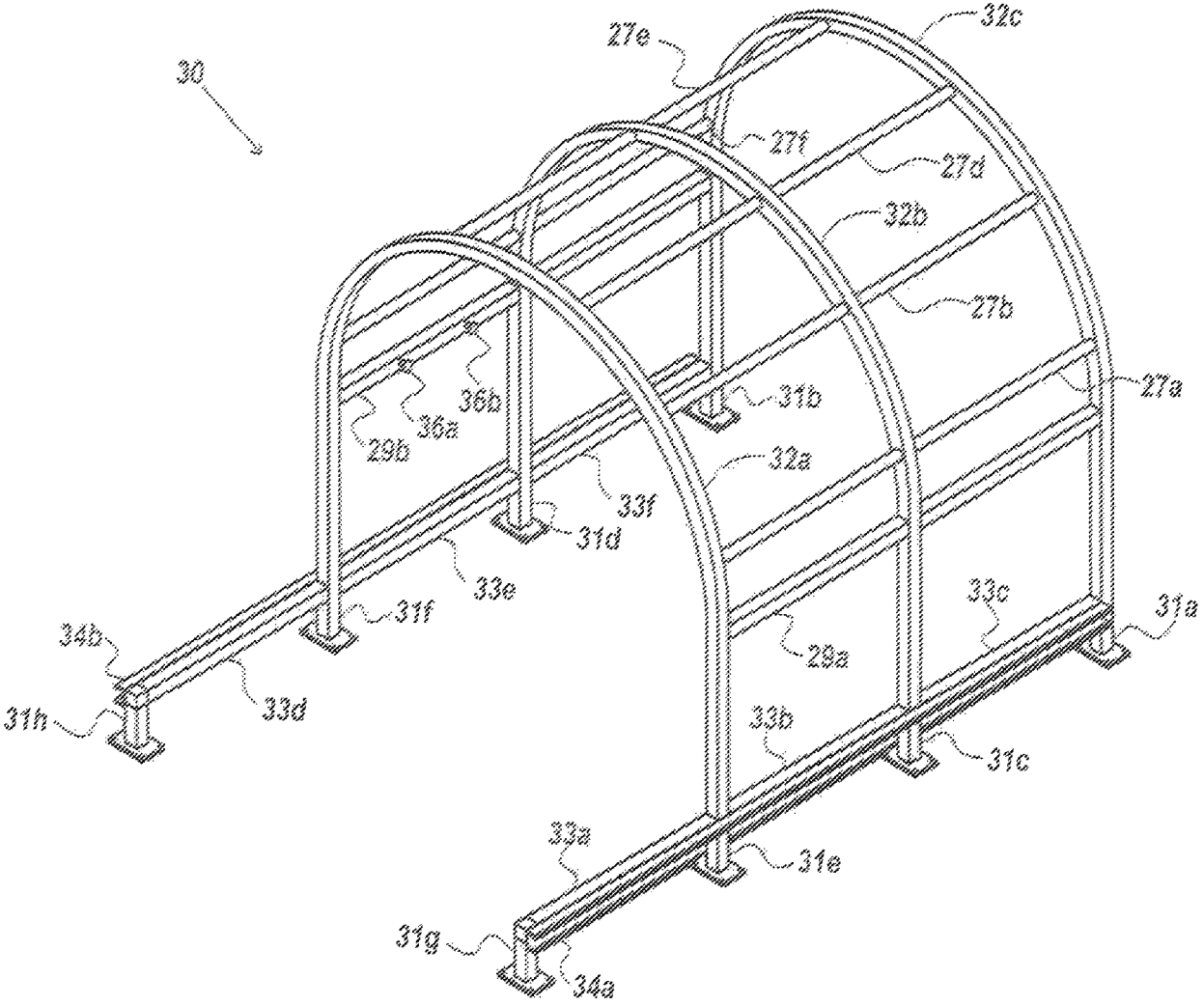
FIG. 2 is a detail of a stationary bowed frame according to one or more embodiments.

FIG. 2 is a detail of the stationary bowed frame 30 configured to be positioned over a floating vessel.

In embodiments, the floating vessel 12 is generally a power boat but could be a small barge or a sailboat with the mast lowered.

The stationary frame 30 can have a plurality of stationary arched roof members 32*a*-32*c*, mounted parallel to each other.

A plurality of lower stationary crossbeams 33*a*-33*f* can be connected between the stationary arched roof members 32*a*-32*c* with one pair of lower stationary crossbeams 33*a*-33*f* extending from the stationary arched roof members 32*a*-32*c* horizontally and parallel to a foundation, such as a dock.

A pair of lower stationary frame tracks 34*a* and 34*b* are secured to the plurality of lower stationary crossbeams 33*a*-33*f* extending from the plurality of stationary arched roof members 32-32*c* and between the plurality of stationary arched roof members 32*a*-32*c*.

The plurality of stationary arched roof members can be supported by a plurality of stationary legs 31*a*-31*f* and two stationary legs can support the lower stationary crossbeams extending from the stationary arched roof members. In embodiments, stationary legs can engage a dock.

The upper stationary cross beams 29*a*-29*b* are connected between the stationary arched roof members 32*a*-32*c* and spaced apart from the lower stationary cross beam 33*a*-33*d* and support rollers to engage the track of the moveable bowed frame.

The stationary bowed frame 30 has plurality of upper track rollers 36*a*-36*b*, wherein each roller 36*a* is mounted to an opposite side of an upper stationary cross beams 29*a*-29*b*.

Roof supports 27*a*-27*f* can be used between the pluralities of stationary arched roof members 32*a*-32*c*. In embodiments from 3 and 10 stationary arched roof supports can be used made from tubing.

Figure 3:
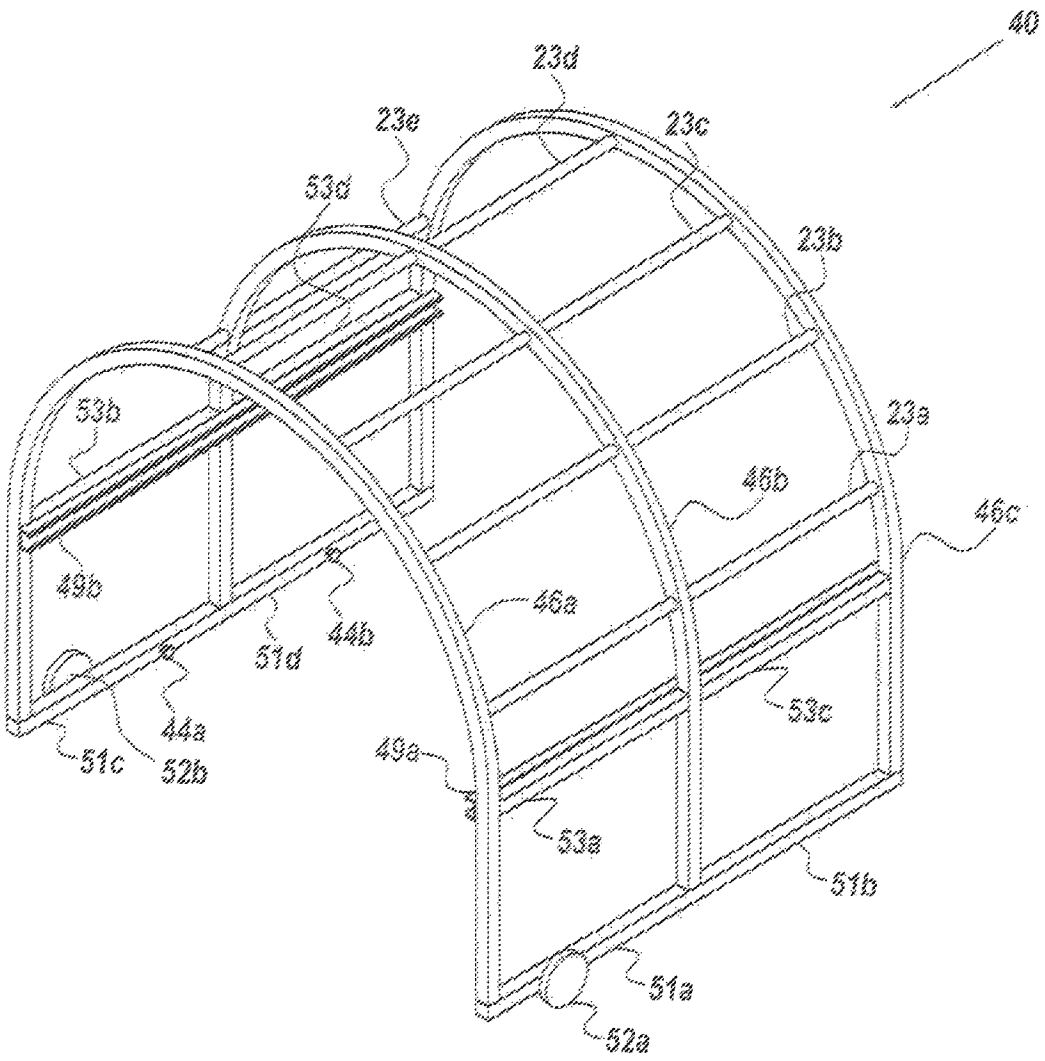
FIG. 3 is a detail of a moveable bowed frame according to one or more embodiments.

FIG. 3 is a detail of a moveable portion of the floating vessel modular protection and security device.

The moveable bowed frame 40 is configured to repeatedly retract and deploy over the stationary bowed frame 30.

The moveable bowed frame 40 has a plurality of moveable arched roof members 46*a*-46*c*.

The moveable bowed frame 40 has a plurality of lower moveable crossbeams 51*a*-51*d* connected between the moveable arched roof member 46*a*-46*c*.

Both sides of the moveable bowed frame 40 have the lower plurality of lower moveable crossbeams supported by wheels 52*a* and 52*b*. The wheels can have wheel locks. The wheel can be mounted to the plurality of moveable arched roof members 46*a*-46*e* for assistance in fixing the moveable bowed frame to a dock.

The moveable bowed frame 40 has upper movable cross beams 53*a*-53*d*, connected between the plurality of moveable arched roof members 46*a*-46*c*.

A pair of upper moveable frame tracks 49*a* and 49*b* are mounted on opposite sides of the moveable arched roof members. Each upper moveable frame track 49*a* and 49*b* is fastened to the upper moveable crossbeam.

Roof supports 23*a*-23*d* can be used between the pluralities of moveable arched roof members. In embodiments, from 3 and 10 moveable arched roof supports can be used made from tubing.

The moveable bowed frame 40 has a plurality of lower movable track rollers 44*a* and 44*b*, wherein each lower movable track roller is mounted to roll in one of the two lower stationary frame tracks 34*ab*.

Figure 4:
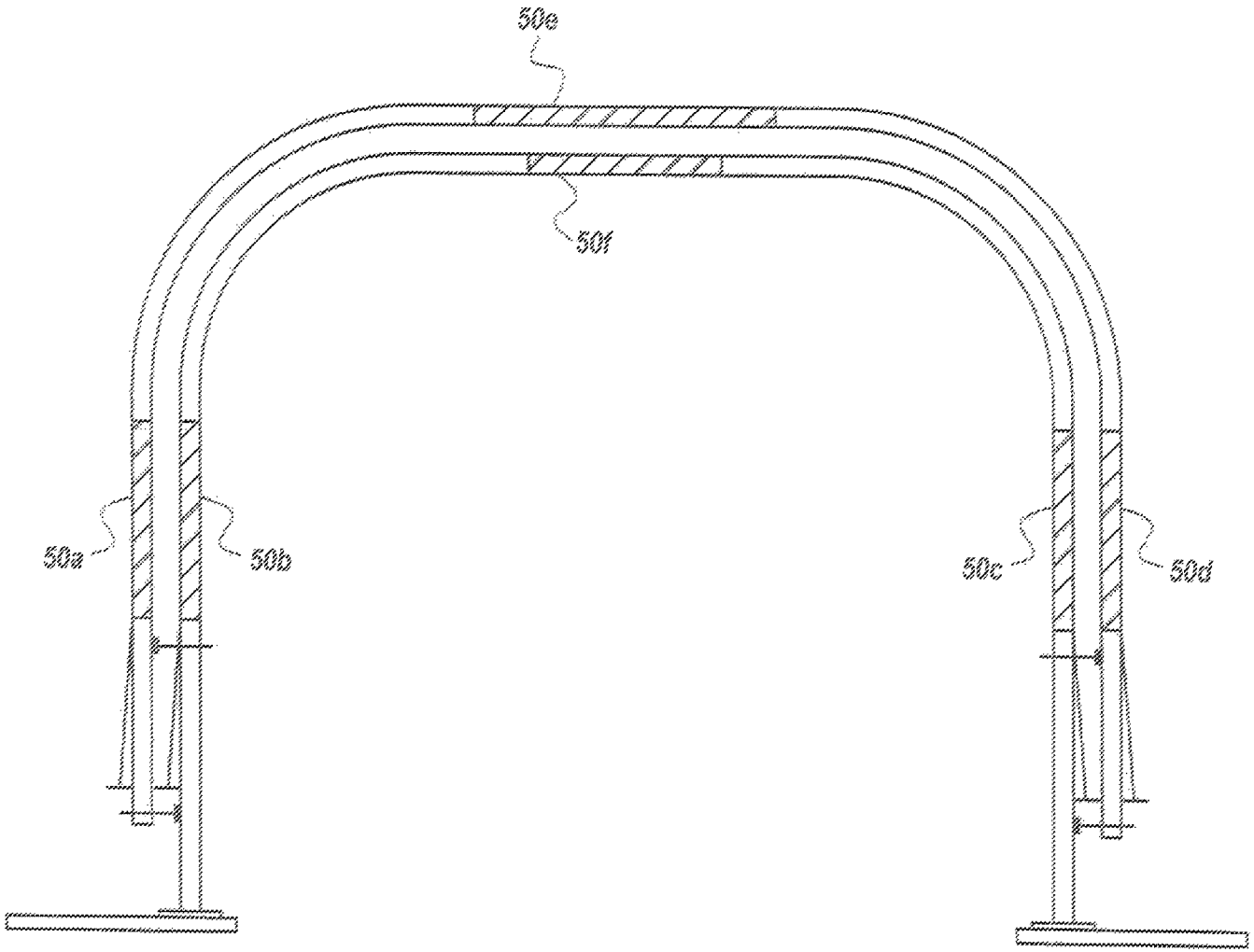
FIG. 4 is a detailed front view of the extensions according to one or more embodiments.

FIG. 4 is a detailed front view of a plurality of extensions 50*a*-50*f*, which can be used for increasing on each stationary bowed frame and each moveable bowed frame. The stationary bowed frame and moveable bowed frame can be increased in at least one of: a height and a width.

Figure 5:
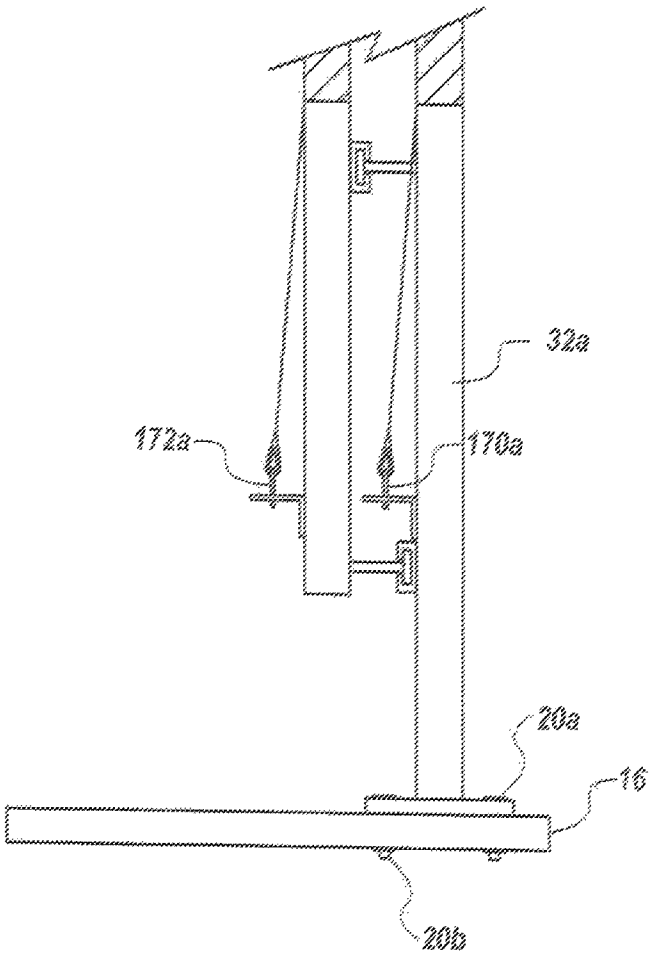
FIG. 5 is a detail view of tensioners according to one or more embodiments.

FIG. 5 is a detail of the tensioners according to one or more embodiments.

The floating vessel modular protection and security device can include a plurality of tensioners 170*a*.

Each tensioner 170*a* can be mounted to one of the stationary arched roof members 32*a*. Each tensioner can be configured for providing a load to the stationary flexible cover 60.

The floating vessel modular protection and security device can include a plurality of moveable bowed frame tensioners 172*a*.

Each of moveable bowed frame tensioners 172*a* is mounted to one of the moveable arched roof members. Each moveable bowed frame tensioner configured for providing a load to the moveable flexible cover.

Removable fasteners 20*a* and 20*b* are shown attaching one of the stationary arched roof members to a dock 16.

In embodiments, the invention can include a motor 120 with worm gear mounted to the stationary bowed frame 30 for extending, and retracting the moveable bowed frame along the stationary frame track, the motor connected to a power supply 124.

In embodiments, the invention can include a remote control 130 connected to a global communication network 107, such as the internee, for actuating the motor 120 from a remote location.

In an embodiment, the invention can include a plurality of stationary cantilever anchor arms, each stationary cantilever anchor arm connected between a pair of stationary legs.

In embodiments, a message area 99 can be installed on the second flexible cover providing safety signage, such as "no wake zone to protect children".

In embodiments, a plurality of tensioners 170*a*-170*c* can be used.

Each tensioner can be mounted to one of the plurality of stationary legs 31*a* where the stationary leg meets the stationary arched roof member 32. Each tensioner can be configured for providing a load to the first internal tubing 62 of the first flexible cover.

In embodiments, a plurality of moveable bowed frame tensioners 172*a*-172*d* can be used. Each moveable bowed frame tensioner can be configured for providing a load to the cover tensioner bar.

In an embodiment, the modular protection and security device moves from 15 feet in length to 25 feet in length.

In an embodiment, the modular protection and security device has an adjustable height from 7 feet to 10 feet.

In an embodiment, the modular protection and security device 10 has an adjustable width from 10 feet to 14 feet.

In an embodiment, the removable fasteners are a pair of clamps that fasten to at least one of: a side of a board and a dock.

In embodiments, extensions of the bowed frames can be 1 foot in length, 2 feet in length, 3 feet in length for the extensions used for height. All extensions for height would have an identical length.

In embodiments, for widths, the extensions to the bowed frame can be 1 foot, 2 feet and 4 feet in length to variably adjust the width of the device over the boat slip. All width extensions would be identical in length.

Example 1

A modular protection and security device with a telescoped or extended length of 24 feet and a width of 10 feet is installed for protecting a FOUR WINNS™ H-220 boat within a 22 foot overall length boat slip.

For this exemplary modular protection and security device, eight (8) removable fasteners secure the modular protection and security device to both starboard and port sides of a dock forming a boat slip for the Four Winns™.

A stationary bowed frame, integrally connected together is crafted from 6063 T-52 grade aluminum square tubing, is first installed to the removable fasteners.

Eight (8) stationary legs are used, one for each removable fastener. Each stationary leg is 10.5 inches in length.

Three (3) stationary arched roof members engage the stationary legs of the stationary bowed frame of this example. Each arched roof member can have a length of 22 feet.

Five (5) stationary crossbeams per side are mounted between pairs of stationary legs. Each stationary crossbeam can be 4 feet 10 inches in height.

Two stationary frame tracks are used, with each stationary frame track mounted to a side of the stationary bowed frame. Each stationary frame track can be C shaped, allowing rollers to roll freely in the frame track.

One upper track roller is mounted in each stationary frame track. Each upper track roller is made from nylon to reduce static charge buildup. Each stationary frame track can be coated to enhance cathodic protection of the device. Each upper track roller can be 4 inches in diameter.

A moveable bowed frame 15 feet long and 6 feet wide is mounted to the upper track rollers. The moveable bowed frame is slidable over the stationary bowed frame by rolling in the stationary frame tracks.

Four arched roof members form the moveable bowed frame.

Twelve (12) moveable bowed frame crossbeams can be mounted between pairs of arched roof members. Each arched roof member can be 23 feet long and made from continuous channel aluminum. Each moveable bowed frame crossbeam can be 4 feet 10 inches long and made from channel aluminum for both strength and light weight.

Two moveable frame tracks are used. Each moveable frame track is mounted to a side of the moveable bowed frame, such as on an upper crossbeam of the moveable bowed frame. Each moveable frame track can be 10 feet long.

Four lower track rollers can be used. Each lower track roller can be mounted to the movable bowed frame positioned for rolling within in the stationary frame tracks.

A first flexible cover, made from 18 ounce ballistic material, is installed over the stationary bowed frame.

The first flexible cover has a first internal tubing is installed on each end of the first flexible cover that extends through the first flexible cover from one end to the other end.

The first flexible cover has a length from end to end that is shorter than a length of the Four Winns™ boat.)

A second flexible cover 70 can be made from the same material as the first flexible cover or a different material, such as a heavy waterproof material.

The second flexible cover can have eyelets formed on the edges of the second flexible cover which enable the second flexible cover to be directly wired to the moveable bowed frame.

The second flexible cover has second internal tubing extending through the second flexible cover from one end to the other end.

The second flexible cover mounted to the moveable bowed frame is configured to fit on top of the moveable bowed frame, wherein the first flexible cover is configured to fit between the moveable bowed frame and the stationary bowed frame.

The second moveable frame with second flexible cover telescopes from the first moveable frame with first flexible cover for a versatile and flexible boat slip cover.

In embodiments, the invention can be used for campers.

In embodiments, the invention can be used to cover Recreational vehicles.

In embodiments, the invention can be used as a hunting shelter, expandable and temporary, in lieu of an RV or a cabin.

Example Two

A floating vessel modular protection and security device 10 has a stationary bowed frame 30. The stationary bowed frame a length of 11 feet and a width of 8 feet and is made from aluminum. The stationary bowed frame is positioned over a 22 foot BRYANT SPRENZA™.

The stationary bowed frame has a plurality of stationary arched roof members. The stationary arched roof members are made from aluminum.

A plurality of lower stationary crossbeams can be connected between the stationary arched roof members and are made of aluminum 5 foot sections.

A first lower stationary frame track can be secured to a first lower stationary cross beam, and a second lower stationary frame track can be secured to a second stationary crossbeam. The first lower stationary frame track second lower stationary frame track can be 15 feet and made from aluminum.

The upper stationary cross beams can be connected between the stationary arched roof members and spaced apart from the lower stationary cross beam and can be made of aluminum 5 foot sections.

A plurality of nylon upper track rollers are mounted to an opposite each side of an upper stationary cross beams.

A moveable bowed frame is configured to repeatedly retract and deploy over the stationary bowed frame 30. The moveable, bowed frame can be 10 feet in length and made of aluminum.

The moveable bowed frame can have a plurality of aluminum moveable arched roof members.

A plurality of aluminum lower moveable crossbeams can be connected between the moveable arched roof member.

An upper movable cross beams is connected between the moveable arched roof members. The upper moveable cross beam is made of aluminum 5 foot sections.

An upper moveable frame tracks is fastened to an upper moveable crossbeam and can be 10 feet in length.

A plurality of nylon lower movable track rollers can be mounted to roll in the lower stationary frame tracks.

A stationary flexible cover extends from one end to the other end of the stationary bowed frame covering the stationary crossbeams. The stationary flexible cover having a length from end to end that is shorter than a length of the floating vessel. The stationary flexible cover can be 10 feet in length and made of vinyl.

A moveable flexible cover extends from one end to the other end of the moveable bowed frame covering the movable bowed frame crossbeams. The stationary flexible cover can be 15 feet in length and made of vinyl.

The movable bowed frame slides on the upper moveable frame track and lower stationary frame track simultaneously, to repeatedly retract and deploy to access or secure a floating vessel. The floating vessel modular protection and security device is mounted on a dock 16 wherein the stationary bowed frame 30 provides a clearance from 10% to 30% above the vessel height overall.

While these embodiments have been described with emphasis on the embodiments, it should be understood that within the scope of the appended claims, the embodiments might be practiced other than as specifically described herein.

What is claimed is:

1. A floating vessel modular protection and security device comprising:

a. a stationary bowed frame configured to be positioned over a floating vessel, the stationary frame comprising:
   i. a plurality of stationary arched roof members;
   ii. a plurality of lower stationary crossbeams connected between the stationary arched roof members;
   iii. a first lower stationary frame track secured to a first tower stationary cross beam, and a second lower stationary frame track secured to the second lower stationary crossbeam;
   iv. a plurality of upper stationary cross beams connected between the stationary arched roof members and spaced apart from the tower stationary cross beam; and
   v. a plurality of upper track rollers, each upper track roller of the plurality of upper track rollers mounted to an opposite side of an upper stationary cross beams;

b. a moveable bowed frame configured to repeatedly retract and deploy over the stationary bowed frame, the moveable bowed frame comprising:
   i. a plurality of moveable arched roof members;
   ii. a plurality of lower moveable crossbeams, connected between the plurality of moveable arched roof member;
   iii a plurality of upper movable cross beams connected between the plurality of moveable arched roof members;
   iv. a plurality of upper moveable frame tracks wherein an upper moveable frame track of the plurality of upper moveable frame tracks is fastened to an upper moveable crossbeam of the plurality of upper moveable cross beams; and
   v. a plurality of lower movable track rollers wherein a lower movable track roller of the plurality of lower moveable track rollers is mounted to roll in the lower stationary frame tracks;

c. a stationary flexible cover extending from one end to the other end of the stationary bowed frame covering the stationary crossbeams; and d a moveable flexible cover extending from one end to the other end of the moveable bowed frame, covering the movable bowed frame crossbeams, wherein the movable bowed frame slides on the upper moveable frame track and lower stationary frame track simultaneously, to repeatedly retract and deploy to access or secure a floating vessel, the floating vessel modular protection and security device mounted on a dock.

2. The floating vessel modular protection and security device of claim 1, wherein the plurality of stationary arched roof members comprises a plurality of stationary legs.

3. The floating vessel modular protection and security device of claim 2, comprising a wheel mounted to the plurality of moveable arched roof members for fixing the moveable bowed frame to the dock.

4. The floating vessel modular protection and security device of claim 1, comprising a wireless camera connected to a power supply connected to a network mounted to one end of the stationary bowed frame.

5. The floating vessel modular protection and security device of claim 1, comprising a plurality of extensions for increasing the stationary bowed frame and the moveable bowed frame at least one of: a height and a width.

6. The floating vessel modular protection and security device of claim 1, comprising a motor with worm gear mounted to the stationary bowed frame for extending and retracting the moveable bowed frame along the stationary frame track, the motor connected to a power supply.

7. The floating vessel modular protection and security device of claim 6, comprising a remote control connected to a network for actuating the motor from a remote location.

8. The floating vessel modular protection and security device of claim 1 comprising a message area on the moveable flexible cover.

9. The floating vessel modular protection and security device of claim 1, comprising a plurality of tensioners, each tensioner of the plurality of tensioners mounted to one of the plurality of stationary arched roof members, each tensioner of the plurality of tensioners configured for providing a load to roof supports of the stationary flexible cover.

10. The floating vessel modular protection and security device of claim 9, comprising a plurality of moveable bowed frame tensioners, each of moveable bowed frame tensioner of the plurality of moveable bowed frame tensioners mounted to one of the plurality of moveable arched roof members, each moveable bowed frame tensioner of the plurality of moveable bowed frame tensioners configured for providing a load to the moveable flexible cover.

11. The floating vessel modular protection and security device of claim 1, comprising a plurality of a plurality of elastic fasteners, wherein the plurality of elastic fasteners secure the stationary flexible cover to the plurality stationary arched roof members and the moveable flexible cover to the plurality of moveable arched roof members.

12. The floating vessel modular protection and security device of claim 1, comprising a plurality of stationary elastic fasteners, wherein the plurality of elastic fasteners secure the moveable flexible cover to the plurality moveable arched roof members.

* * * * *